US005400013A

United States Patent [19]

Mochizuki

[11] Patent Number: 5,400,013

[45] Date of Patent: Mar. 21, 1995

[54] IONIZATION TYPE SMOKE DETECTOR

[76] Inventor: Mikio Mochizuki, c/o Nohmi Bosai Ltd. 7-3, Kudan Minami 4-chome, Chiyoda-ku, Tokyo, Japan

[21] Appl. No.: 63,674

[22] Filed: May 19, 1993

[30] Foreign Application Priority Data

May 25, 1992 [JP] Japan ..... 4-132887

[51] Int. Cl.[6] ..... G08B 17/10

[52] U.S. Cl. ..... 340/629; 250/384

[58] Field of Search ..... 340/628, 629, 630; 250/384, 385.1

[56] References Cited

U.S. PATENT DOCUMENTS

| | | | |
|---|---|---|---|
| 3,866,195 | 2/1975 | Ried, Jr. . | |
| 4,081,795 | 3/1978 | Ogawa | 340/629 |
| 4,091,363 | 5/1978 | Siegel et al. | 340/629 X |
| 4,097,850 | 6/1978 | Conforti . | |
| 4,193,069 | 3/1980 | Cooper et al. . | |
| 4,364,031 | 12/1982 | Scheidweiler et al. | 340/629 |
| 4,524,351 | 6/1985 | Kimura et al. . | |
| 4,825,196 | 4/1989 | Morita . | |
| 5,189,399 | 2/1993 | Beyersdorf | 340/629 |

*Primary Examiner*—Jeffery A. Hofsass

[57] ABSTRACT

An ionization type smoke detector includes a smoke detecting section including an intermediate electrode and an outer electrode to confine an outer ionization chamber therebetween into which smoke to be detected is introduced, and a reference resistance section for forming a reference resistance with respect to the outer ionization chamber, and a sensor output section including a first transistor with its gate connected to the intermediate electrode, and a serial circuit connected to a source of the first transistor and consisting of a first fixed resistor and a first constant-current circuit having a first variable resistor for output adjustment, the sensor output section producing a sensor output from a junction between the first constant current circuit and the first fixed resistor; a fire discriminating section including a reference voltage generating circuit having a second variable resistor for reference voltage adjustment, the fire discriminating section producing a discrimination output when the sensor output exceeds a reference voltage; and fire signal transmitting section for transmitting a fire signal in response to the discrimination output. The sensitivity is easily adjusted and a current flowing during fire monitoring is not changed with different supply voltages.

19 Claims, 3 Drawing Sheets

IONIZATION TYPE SMOKE DETECTOR

BACKGROUND OF THE INVENTION

1. Field of the Invention

The present invention relates to an ionization type smoke detector.

2. Description of the Related Art

A conventional ionization type smoke detector comprises a smoke detecting section having an inner ionization chamber defined between an inner electrode and an intermediate electrode and functioning as a reference resistance element, and an outer ionization chamber defined between the intermediate electrode and an outer electrode; a sensor output section for detecting a voltage change across the outer ionization chamber of the smoke detecting section and outputting the voltage change as a sensor output; a fire discriminating circuit for producing a fire discrimination output when the sensor output reaches a fire discrimination level; and a fire signal transmitting section for transmitting a fire signal in response to the fire discrimination output, thereby carrying out fire monitoring. Also, a constant-voltage circuit is provided in the conventional ionization type smoke detector to ensure stable fire monitoring even if the detector is connected to any of various fire receivers having different supply voltages.

A sensitivity of the conventional ionization type smoke detector is adjusted as follows. (1) In the case where fire discrimination is effected upon the turning-on of a MOS (Metal Oxid Semiconductor) type field effect transistor with its gate connected to the intermediate electrode, the resistance value of a resistor which is connected to a source of the MOS type field effect transistor is adjusted. (2) In the case where fire discrimination is effected by a comparator, the resistance value of a voltage dividing resistor which applies a reference voltage for the fire discrimination to the comparator is adjusted.

In either of the above sensitivity adjusting methods, however, the adjustment has been troublesome because of the necessity of selecting a different resistance value for each of the detectors. Further, in the conventional detectors, the voltage at which the MOS type field effect transistor turns on or the voltage at which the comparator produces the fire discrimination output, i.e., the sensor output obtained from the outer ionization chamber varies with each detector. Accordingly, in order to check how far the sensor output under a smoke-free condition in use has deviated from an initial value, the initial value must be subtracted from the current sensor output for each detector, which has been laborious procedure.

Furthermore, the constant-voltage circuit of the conventional ionization type smoke detector comprises a transistor, a Zener diode connected to a base of the transistor, and a resistor connected between a collector and the base of the transistor.

However, when a high voltage is supplied from a fire receiver, the current flowing through the Zener diode of the constant-voltage circuit becomes larger than in the case of a low supply voltage being supplied. Accordingly, the number of detectors connectable to the fire receiver must should be restricted, or it is necessary to increase the capacity of a battery power supply which is provided for backup in case of a main power failure.

SUMMARY OF THE INVENTION

An object of the present invention is to solve the above-mentioned problems in the prior art and to provide an ionization type smoke detector in which the sensitivity can be easily adjusted and the current needed during fire monitoring is not changed even with different supply voltages.

An ionization type smoke detector according to the present invention comprises:

a smoke detecting section including an intermediate electrode and an outer electrode positioned opposite to each other to confine an outer ionization chamber therebetween into which smoke to be detected is introduced, and a reference resistance circuit for forming a reference resistance with respect to said outer ionization chamber;

A sensor output circuit including a first transistor with its gate connected to the intermediate electrode of said smoke detecting section, and a serial circuit connected to a source of said first transistor and consisting of a first fixed resistor and a first constant-current circuit having a first variable resistor for output adjustment, said sensor output circuit producing a sensor output from a junction between the first constant-current circuit and the first fixed resistor of said serial circuit;

a fire discriminating circuit means including a reference voltage generating circuit having a second variable resistor for reference voltage adjustment, said fire discrimimating circuit producing a discrimination output when the sensor output from said sensor output circuit exceeds a reference voltage generated by said reference voltage generating circuit; and A fire signal transmitting circuit for transmitting a fire signal in response to the discrimination output from said fire discriminating circuit.

DESCRIPTION OF THE PREFERRED EMBODIMENTS

Figure 1:
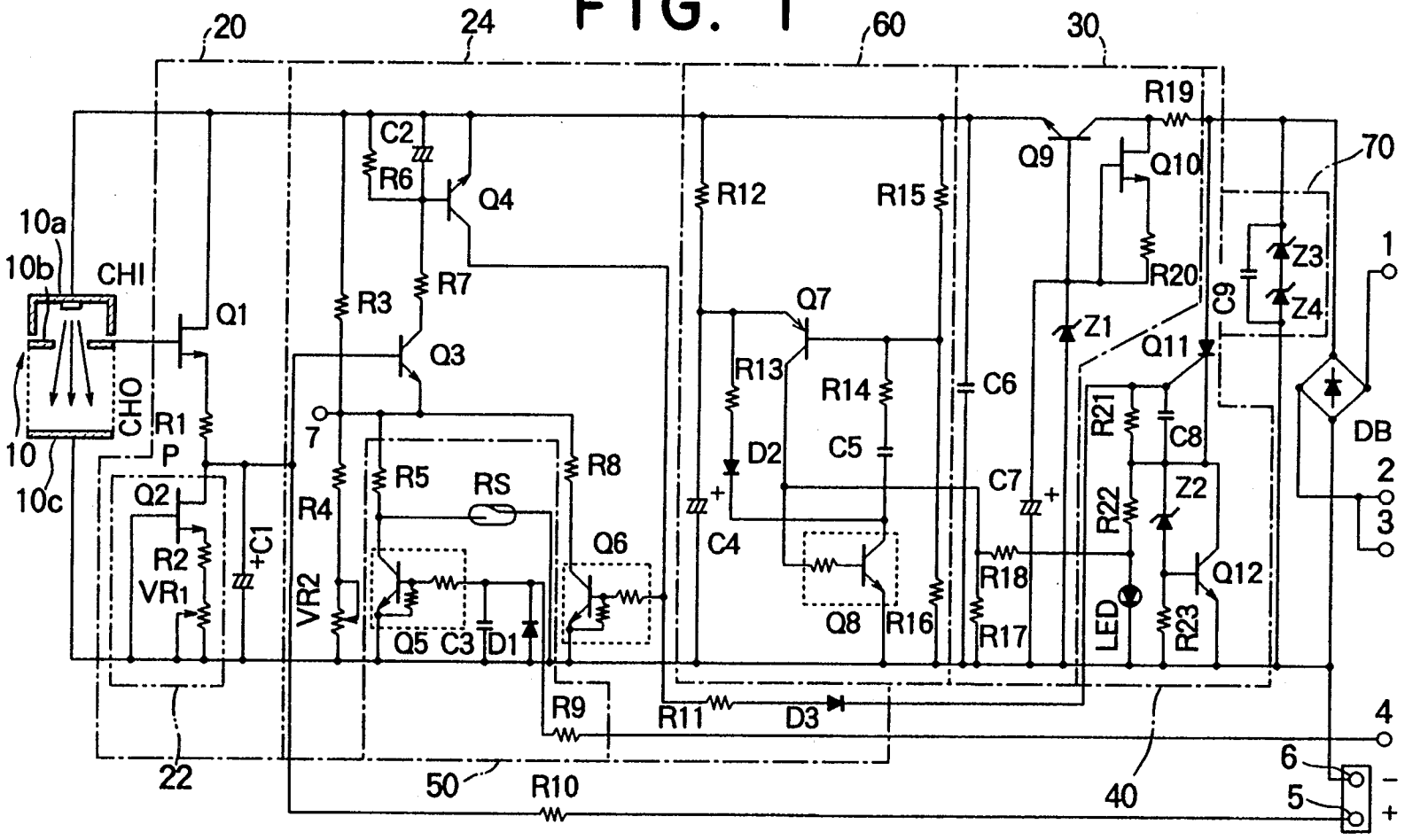
FIG. 1 is a circuit diagram showing an ionization type smoke detector according to one embodiment of the present invention.

Preferred embodiments of the present invention will be described with reference to the attached drawings. In FIG. 1, a fire discriminating circuit 24 is connected to a smoke detecting section 10 via a sensor output section 20, and a fire signal transmitting section 40 is connected to the fire discriminating circuit 24 via an Oscillation circuit 60 and a constant-voltage circuit 30. A test circuit 50 is also connected to the fire discriminating circuit 24. Further, a surge voltage absorbing circuit 70 is connected to the fire signal transmitting section 40, and terminals 1 to 3 are connected to the section 40 via a diode bridge circuit DB. An input terminal 4 is connected to the test circuit 50; a terminal 5 is connected to an output of the sensor output section 20 via a resistor R10; a terminal 6 is connected to the diode bridge circuit DB, and a terminal 7 is connected to the fire discriminating circuit 24.

The smoke detecting section 10 has an inner ionization chamber CHI confined between an inner electrode 10*a* and an intermediate electrode 10*b* and functioning as a reference resistance element, and an outer ionization chamber CHO confined between the intermediate electrode 10*b* and an outer electrode 10*c*.

The sensor output section 20 comprises a junction type field effect transistor (J-FET) Q1 with its gate connected to the intermediate electrode 10*b*, a first fixed resistor R1 connected to a source of the transistor Q1, a capacitor C1, and a, constant-current circuit 22. Also, the constant current circuit 22 comprises a junction type field effect transistor (J-FET) Q2, a resistor R2, and a variable resistor VR1 for output adjustment.

The fire discriminating circuit 24 comprises transistors Q3, Q4 and Q6, a second fixed resistor R3, a third fixed resistor R4, other fixed resistors R6 to R8 and R11, a diode D3, a variable resistor VR2 for reference voltage adjustment, and a capacitor C2. In more detail, the fire discriminating circuit 24 comprises: a voltage dividing circuit consisting of the second fixed resistor R3, the third fixed resistor R4 and the variable resistor VR2 which are connected in series; the first transistor Q3 for fire discrimination with its emitter connected to a junction between the second fixed resistor R3 and the third fixed resistor R4 of the voltage dividing circuit and with its base is connected to a point P of the sensor output section 20, the second transistor Q4 operated upon turning-on of the first transistor Q3 to deliver a fire discrimination output, and the third transistor Q6 connected in series with the emitter of the first transistor Q3 and operating in response to the fire discrimination output delivered from the second transistor Q4, thereby constituting a positive feedback circuit for the first transistor Q3.

In the fire discriminating circuit 24, when the transistor Q3 turns on upon the sensor output from the sensor output section 20 exceeding the reference voltage determined by the resistors R3 and R4 and the variable resistor VR2, the transistors Q3 and Q4 and the transistor Q6 cooperatively form a positive feedback circuit. Therefore, the switching operation is surely done by turning-on of the first transistor Q3.

The constant-voltage circuit 30 comprises transistors Q9 and Q10, resistors R17 to R20, capacitors C6 and C7, and a Zener diode Z1. This constant-voltage circuit 30 converts a source voltage supplied from a fire receiver or a transmitter (not shown) into a predetermined constant voltage and supplies it to the smoke detecting section 10, the sensor output section 20, the fire discriminating circuit 24 and the oscillation circuit 60. More specifically, the Zener diode Z1 is connected to a base of the transistor Q9, and a constant-current circuit comprising the junction type field effect transistor Q10 and the resistor R20 is connected between a collector and the base of the transistor Q9.

The fire signal transmitting section 40 comprises a silicon controlled rectifier (switching element) Q11, an operation indicating lamp LED, a serial circuit of a Zener diode Z2 and a resistor R23 connected in parallel with the operation indicating lamp LED, a transistor Q12 with its base connected to an intermediate junction in the above serial circuit, resistors R21 and R22, and a capacitor C8.

The switching element Q11 of the transmitting section 40 operates in response to the fire discrimination output from the fire discriminating circuit 24 and transmits a fire signal. When a voltage higher than the Zener voltage of the Zener diode Z2 is applied to a serial circuit of the operation indicating lamp LED and the resistor R22 during transmission of the fire signal for the reason that the detector is connected to a fire receiver having a higher supply voltage or that the supply voltage from a fire receiver is shifted to a higher level, the Zener diode Z2 becomes conducting to turn on the transistor Q12, whereby the voltage applied to the operation indicating lamp LED is held down to the Zener voltage of the Zener diode Z2. As a result, a failure of the operation indicating lamp LED can be prevented.

The test Circuit 50 comprises a transistor Q5 turning on when a test signal is applied to the input terminal 4 from the outside, resistors R5 and R9, a capacitor C3, a diode D1, and a reed switch RS turning on when a magnetic field is applied from the outside. The transistor Q5 and the reed switch RS are provided in parallel with the serial circuit of the resistor R4 and the variable resistor VR2 in the fire discriminating circuit 24.

The oscillation circuit 60 comprises transistors Q7 and Q8, resistors R12 to R16, capacitors C4 and C5, and a diode D2. The oscillation circuit 60 is to turn on and off the operation indicating lamp LED of the fire signal transmitting section 40 for blinking while the source voltage is supplied to the detector.

The surge voltage absorbing circuit 70 comprises Zener diodes Z3 and Z4 and a capacitor C9. A pair of power-supply/signal lines (not shown) are connected to the terminals 1 and 2 or 3.

The operation of this embodiment will now be described. During fire monitoring, the source voltage supplied to the terminals 1 and 2 or 3 from a fire receiver or a transmitter (not shown) via the pair of power-supply/signal lines is converted by the constant-voltage circuit 30 into a predetermined constant voltage which is then supplied to the smoke detecting section 10, the sensor output section 20, the fire discriminating circuit 24, and the oscillation circuit 60.

In the constant-voltage circuit 30, the constant current circuit comprising the transistor Q10 and the resistor R20 has a function of making a current constant so that the current flowing through the Zener diode Z1 is kept constant and hence the current flowing in the constant voltage circuit 30 is held constant. Accordingly, even when the source voltage supplied from the fire receiver or the like varies, the current flowing in the constant-voltage circuit 30 will not be changed.

In the oscillation circuit 60, when the capacitor C4 is charged and a resulting charged voltage reaches a value of the sum of the reference voltage determined by a ratio of the resistance value of the resistor R15 to that of the resistor R16 and the emitter—collector voltage of the transistor Q7, the transistor Q7 turns on and, correspondingly, the transistor Q8 also turns on. The charges on the capacitor C4 is thereby discharged and a resulting discharge current turns on the operation indicating lamp LED of the fire signal transmitting section 40. The capacitor C4 is repeatedly charged and discharged in this way and, as a result, the operation indicating lamp LED is intermittently turned on to indicate that the fire monitoring is going on.

The junction type field effect transistor Q1 of the sensor output section 20 is kept conducting by the smoke detection output from the smoke detecting section 10 during the fire monitoring, causing a constant current to flow through the resistor R1 under an action of the constant current circuit 22. Accordingly, a drain current of the field effect transistor Q1 remains constant so that a potential at the junction P between the resistor R1 and the constant-current circuit 22 changes in 1 : 1 relation to a resistance change of the outer ionization chamber CHO of the smoke detecting section 10 due to incoming smoke, i.e., a change in the gate voltage of the field effect transistor Q1.

When smoke produced with fire flows into the outer ionization chamber CHO and the potential at the junction P between the resistor R1 and the constant-current circuit 22 rises to such an extent that the charged voltage of the capacitor C1 reaches a value of the sum of the reference voltage determined by the resistors R3, R4 and the variable resistor VR2 and the base —emitter voltage of the transistor Q3, the transistor Q3 turns on. Upon this turning-on of the transistor Q3, both the transistor Q4 and the transistor Q6 turn on, causing the transistors Q3 and Q4 and the transistor Q6 to form the positive feedback circuit so that the fire discriminating circuit 24 is perfectly operated.

In response to the output produced upon operation of the fire discriminating circuit 24, the silicon controlled rectifier (switching element) Q11 of the fire signal transmitting section 40 turns on to transmit the fire signal through the terminals 1 and 2 or 3. Simultaneously, the fire signal switches the operation indicating lamp LED from a blinking mode to a continuously illuminating mode.

Then, when the source voltage supplied from the fire receiver or the like rises to increase the current flowing through the serial circuit of the resistor R22 and the operation indicating lamp LED to such an extent that a voltage drop across the same serial circuit exceeds the Zener voltage of the Zener diode Z2, the Zener diode Z2 conducts to prevent an excessive increase of the current flowing through the operation indicating lamp LED.

To make a sensitivity adjustment of the detector, the voltage between the terminals 7 and 6, i.e., the reference voltage as a reference for the fire discrimination, is first adjusted to a first predetermined voltage V1 by manipulating the variable resistor VR2 of the fire discriminating circuit 24 while measuring the voltage between the terminals 7 and 6.

Next, under a condition that no smoke flows into the outer ionization chamber CHO of the smoke detecting section 10, the voltage between the terminals 5 and 6, i.e., the output voltage of the sensor output section 20, is adjusted to a second predetermined voltage V2 ($V1>V2$) by manipulating the variable resistor VR1 of the constant-current circuit 22 while measuring the voltage between the terminals 5 and 6. By so adjusting, it is possible to compensate for variations of the sensor output depending on difference in the radiation amount of a radioactive source such as americium 241 placed on the inner electrode 10*a* of the smoke detecting section 10, or in size of the outer ionization chamber CHO.

Since the reference voltage for the fire discrimination is adjusted to the first predetermined voltage V1 by using the variable resistor VR2, the same reference voltage can be set in plural detectors. This simplifies the sensitivity adjustment during the manufacturing process of detectors and other occasions. In addition, measuring the voltage between the terminals 5 and 6 enables direct reading of the sensor output voltage, and measuring the voltage between the terminals 7 and 6 enables direct reading of the reference voltage. Accordingly, the test for routine check and the like is simplified.

In order to test whether or not the detector operates normally, a test voltage is applied to the terminal 4 from a receiver or a transmitter (not shown), then the transistor Q5 of the test circuit 50 turns on. Alternatively, when a magnet (not shown) is approached to the reed switch RS from the outside of a cover (not shown) of the detector instead of using a test voltage, the reed switch RS is turned on.

Upon this turning-on of the transistor Q5 or the reed switch RS, the resistor R5 is connected in parallel with the serial circuit of the resistor R4 and the variable resistor VR2, whereby the reference voltage for the fire discrimination is forcibly lowered.

At this time, if the potential at the junction P between the resistor R1 and the constant-current circuit 22 is within a normal range, the fire discriminating circuit 24 is operated to make the silicon controlled rectifier Q11 of the fire signal transmitting section 40 turn on and also shift the operation indicating lamp LED into a continuously illuminating mode. From this result, it is seen that the detector can normally detect smoke.

On the other hand, if the potential at the junction P is not within the normal range and the detector is in such a condition as failing to normally detect smoke for the reason that the ionization current is reduced because of the dust deposit in the outer ionization chamber CHO or the contamination of the surface of the radioactive source, the fire discriminating circuit 24 is not operated, hence no fire signal is delivered and the operation indicating lamp LED remains in a blinking mode. From this result, it can be seen that the detector is in such a condition as failing to alarm.

Figure 2:
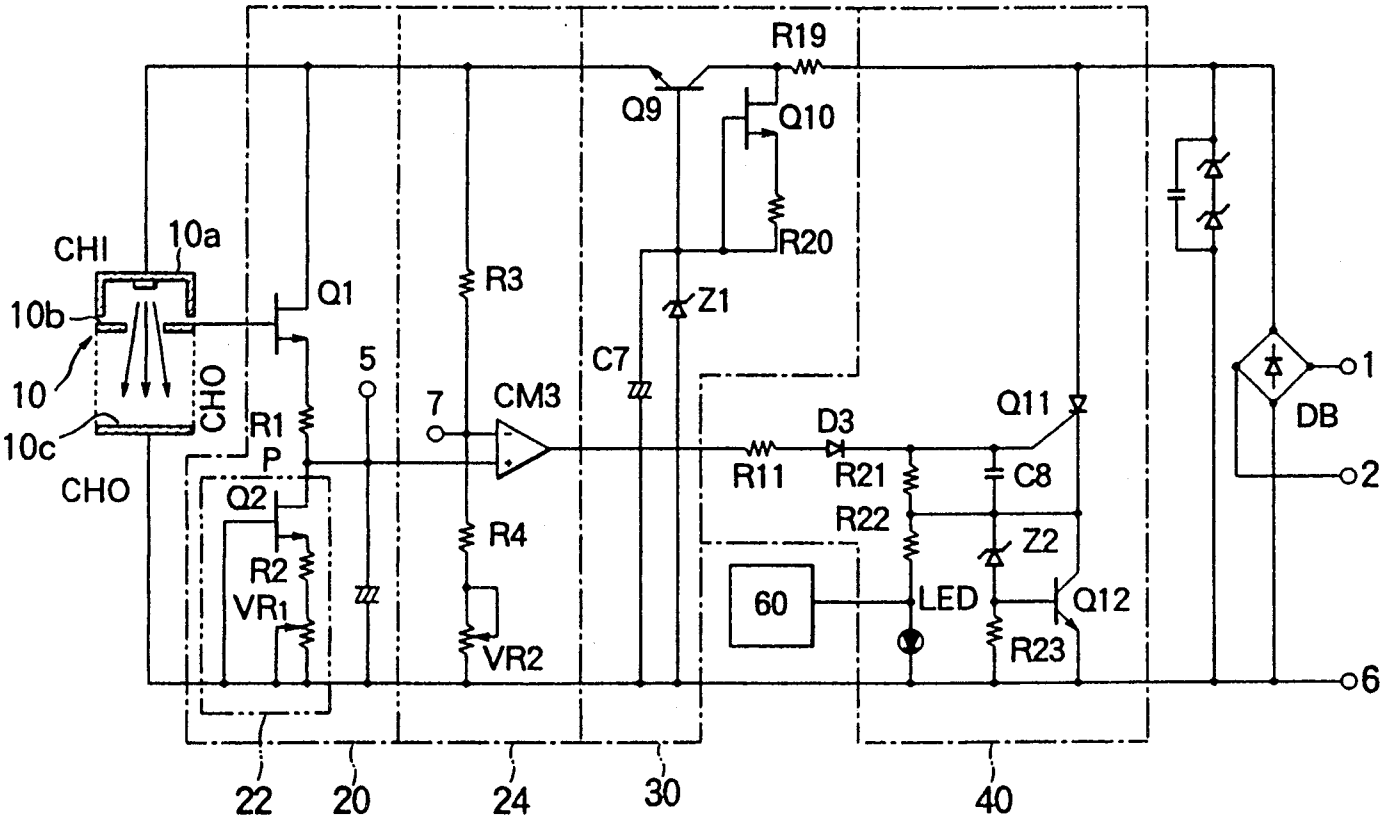
FIG. 2 is a circuit diagram showing another embodiment if the present invention

The present invention is not limited to the abovementioned embodiment but may be constructed, for example, as shown in FIG. 2. A detector of this embodiment comprises, similar to the embodiment of FIG. 1, a smoke detecting section 10 having an inner ionization chamber CHI and an outer ionization chamber CHO, a sensor output section 20 for detecting a voltage change across the outer ionization chamber CHO and outputting the voltage change as a sensor output, a fire discriminating circuit 24*a* for producing a fire discrimination output when the sensor output reaches a predetermined fire discrimination level, a constant-voltage circuit 30, a fire signal transmitting section 40 for transmitting a fire signal in response to the fire discrimination output, and an oscillation circuit 60 for turning on and off an operation indicating lamp LED of the fire signal transmitting section 40 for blinking. Although not shown, a test circuit similar to the test circuit 50 in the embodiment of FIG. 1 is also provided.

The sensor output section 20 is constituted by a serial circuit of a junction type field effect transistor Q1 with its gate connected to an intermediate electrode 10*b* of the smoke detecting section 10, a first fixed resistor R1 connected to a source of the transistor Q1, and a constant-current circuit 22 having a variable resistor VR1 for output adjustment. A sensor output is taken out from an intermediate junction P between the resistor R1 and the constant-current circuit 22 of the above serial circuit.

The fire discriminating circuit 24*a* comprises a voltage dividing circuit consisted of fixed resistors R3 and R4 and variable resistor VR2 for reference voltage adjustment which are connected in series to produce a reference voltage. The circuit 24*a* also includes a comparator CM3 having one input terminal to which the sensor output from the sensor output section 20 is applied, and the other input terminal to which the reference voltage is applied from the voltage dividing circuit.

Then, similarly to the embodiment of FIG. 1, the sensor output from the sensor output section 20 at predetermined smoke density is adjusted to a predetermined output value by manipulating the variable resistor VR1 for output adjustment, while the reference voltage produced in the fire determining circuit 24*a* is adjusted to a predetermined reference voltage by manipulating the variable resistor VR2 for reference voltage adjustment.

Additionally, an external output terminal 5 for delivering the sensor output to the exterior is connected to the intermediate junction P between the fixed resistor R1 and the constant-current circuit 22 in the sensor output section 20. An external output terminal 7 for delivering the reference voltage to the exterior is connected to a point where the reference voltage is produced by the voltage dividing circuit in the fire discriminating circuit 24.

Figure 3:
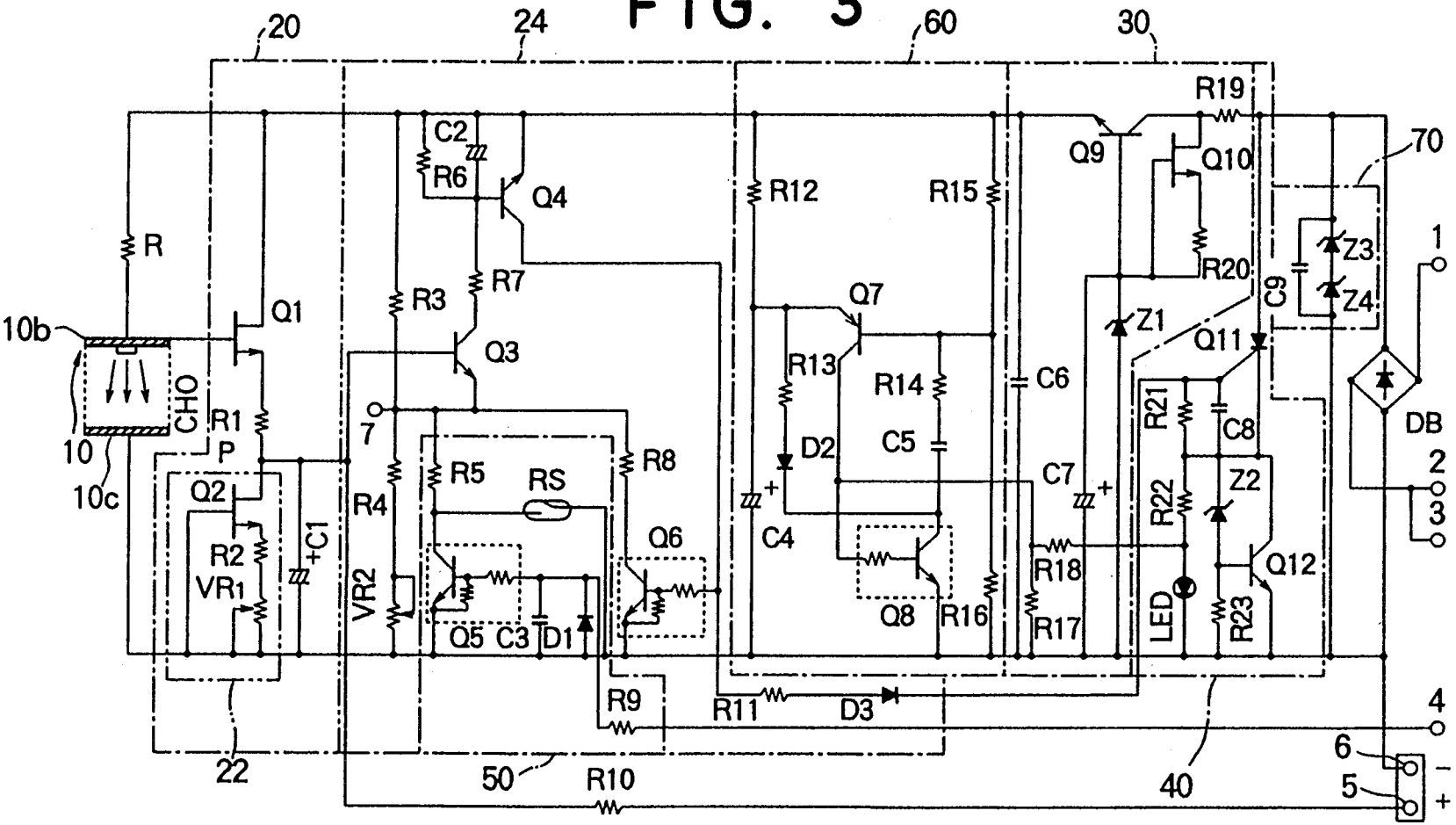
FIG. 3 is a circuit diagram showing still another embodiment of the present invention.

It should be noted that although the inner ionization chamber CHI is used as a reference resistance element for the smoke detecting section 10 in each embodiment, a resistor having a high resistance value may be used instead of the inner ionization chamber. FIG. 3 illustrates such an embodiment which corresponds to the embodiment of FIG. 1 with resistor R being substituted for the inner inoization chamber CHI.

The ionization type smoke detector of the present invention constructed as explained above have the following remarkable advantages.

(1) The sensor output section 20 can produce the sensor output in proportion to, i.e., in 1: 1 relation to, the detection output of the smoke detecting section 10 (the change of the output voltage of the intermediate electrode 10*b*), and can be easily adjusted so as to produce the same sensor output for various detectors at predetermined smoke density (e.g., at smoke density of 0%, 5% or 10%). Also, by manipulating the variable resistor VR2 for reference voltage adjustment of the fire discriminating circuit 24 or 24*a*, the reference voltage for fire discrimination produced in the fire discriminating circuit 24 or 24*a* a can be easily adjusted to the same value for various detectors. Accordingly, by setting the sensor output from the sensor output section 20 to the same value for various detectors and setting the reference voltage for fire discrimination to the same value for various detectors, it is possible to readily recognize a sensitivity change of the detector in use, i.e., a difference between the reference voltage and the sensor output.

(2) Since the constant-voltage circuit 30 includes a constant-current circuit for restricting a current flowing through the Zener diode Z1, the current flowing through the Zener diode Z1 is held down to a predetermined constant value by the constant-current circuit regardless of the primary side voltage of the constant-voltage circuit 30. Accordingly, even when the source voltage supplied from a receiver, for example, to the detector varies during fire monitoring, the current flowing in the constant-voltage circuit 30 will not be changed. Further, since the current flowing in the constant-voltage circuit 30 is not affected by the primary side voltage, the current flowing in the constant-voltage circuit 30 during the fire monitoring is not changed even with different voltages supplied to the detector from receivers or the like, thus making the detector adaptable for various types of receivers.

What is claimed is:

1. An ionization type smoke detector comprising:

a smoke detecting section including an intermediate electrode and an outer electrode positioned opposite to each other to confine an outer ionization chamber therebetween into which smoke to be detected is introduced, and a reference resistance circuit electrically connected to said outer ionization chamber, said reference resistance circuit forming a reference resistance with respect to said outer ionization chamber;

a sensor output circuit including: a first transistor having a gate and a source, said gate being connected to said intermediate electrode of said smoke detecting section, and a serial circuit connected to said source of and first transistor and consisting of a first fixed resistor and a first constant-current circuit having a first variable resistor for adjustment of an output current of said first constant-current circuit, said sensor output circuit producing a sensor output from a junction between said first constant-current circuit and said first fixed resistor of said serial circuit;

a fire discriminating circuit for receiving said sensor output from said sensor output circuit and including a reference voltage generating circuit having a second variable resistor for reference voltage adjustment, said fire discrimination circuit producing a discrimination output when said sensor output from said sensor output means exceeds a reference voltage generated by said reference voltage generating circuit; and a fire signal transmitting circuit for receiving said discrimination output from said fire discriminating circuit and for transmitting a fire signal in response to said discrimination output from said fire discriminating circuit.

2. A detector according to claim 1, further comprising a constant-voltage circuit for converting an externally supplied source voltage into a predetermined voltage and for supplying said predetermined voltage to both said first transistor of said sensor output circuit and said fire discriminating circuit.

3. A detector according to claim 2, wherein said constant-voltage circuit includes: a second transistor having an emitter connected to said smoke detecting section, said first transistor of said sensor output circuit and said fire discriminating circuit; a first Zener diode having one end connected to a base of said second transistor; and a second constant current circuit connected between a collector and said base of said second transistor, said externally supplied source voltage being supplied between said collector of said second transistor and another end of said first Zener diode.

4. A detector according to claim 3, wherein said reference voltage generating circuit of said fire discriminating circuit includes second and third fixed resistors and said second variable resistor connected in series between said emitter of the second transistor in said constant-voltage circuit and said another end of said first Zener diode.

5. A detector according to claim 4, wherein said fire discriminating circuit includes: a third transistor having a base connected to an output of said sensor output circuit and having an emitter connected to a junction between said second fixed resistor and said third fixed resistor; a fourth transistor operated upon turning-on of said third transistor to deliver said discrimination output; and a fifth transistor connected in series to the said emitter of said third transistor and operated in response to said discrimination output delivered from said fourth transistor, thereby constituting a positive feedback circuit for said third transistor.

6. A detector according to claim 4, wherein said fire discriminating circuit includes a comparator having one input terminal to which an output of said sensor output circuit is connected and having another input terminal to which said junction between said second fixed resistor and said third fixed resistor is connected.

7. A detector according to claim 1, wherein said fire signal transmitting circuit includes a switching element operated in response to said discrimination output from said fire discriminating circuit for transmitting said fire signal.

8. A detector according to claim 7, wherein said fire signal transmitting circuit has an indicating lamp connected in series with said switching element.

9. A detector according to claim 8, wherein said fire signal transmitting circuit includes: a series circuit of a second Zener diode and a fourth fixed resistor, said series circuit being connected in parallel to said indicating lamp, and a sixth transistor connected in parallel to said indicating lamp and having a base connected to a junction between said second Zener diode and said fourth fixed resistor.

10. A detector according to claim 1, further comprising a first output terminal connected to a junction between said first constant-current circuit and said first fixed resistor of said sensor output circuit.

11. A detector according to claim 4, further comprising a second output terminal connected to a junction between said second fixed resistor and said third fixed resistor of said fire discriminating circuit.

12. A detector according to claim 1, further comprising a test circuit forcibly lowering said reference voltage generated by said reference voltage generating circuit of said fire discriminating circuit in response to an externally supplied signal.

13. A detector according to claim 12, wherein said test circuit includes a reed switch connected in parallel to said second variable resistor and turned on by an externally applied magnetic field.

14. A detector according to claim 12, wherein said test circuit includes: a second transistor connected in parallel to said second variable resistor; a protective resistor connected to a base of said seventh transistor; and a test signal input terminal connected to said protective resistor.

15. A detector according to claim 1, wherein the reference resistance circuit of said smoke detecting section includes an inner electrode positioned opposite to said intermediate electrode and confining an inner ionization chamber between said inner electrode and said intermediate electrode.

16. A detector according to claim 1, wherein the reference resistance circuit of said smoke detecting section comprises a resistor.

17. A detector according to claim 1, wherein said first transistor of said sensor output means is a junction type field effect transistor.

18. A detector according to claim 1, wherein said first constant-current circuit of said sensor output means includes a junction type field effect transistor and a second fixed resistor.

19. A detector according to claim 3, wherein said second constant-current circuit of said constant-voltage circuit includes a junction type field effect transistor and a second fixed resistor.

* * * * *